US005588603A

United States Patent [19]

Nakaji

[11] Patent Number: 5,588,603

[45] Date of Patent: Dec. 31, 1996

[54] YARN TAKE-UP TUBE SUPPLYING APPARATUS FOR A WINDER

[75] Inventor: Fumiaki Nakaji, Kyoto, Japan

[73] Assignee: Murata Kikai Kabushiki Kaisha, Kyoto, Japan

[21] Appl. No.: 468,752

[22] Filed: Jun. 6, 1995

[30] Foreign Application Priority Data

Jun. 13, 1994 [JP] Japan ..... 6-155256

[51] Int. Cl.[6] ..... B65H 54/02; B65H 63/00

[52] U.S. Cl. ..... 242/35.5 A; 242/36

[58] Field of Search ..... 242/35.5 A, 35.5 R, 242/36

[56] References Cited

U.S. PATENT DOCUMENTS

| | | | |
|---|---|---|---|
| 4,606,508 | 8/1986 | Gartner | 242/35.5 A X |
| 4,610,405 | 9/1986 | Noshi | 242/35.5 A |
| 4,865,260 | 9/1989 | Colli et al. | 242/35.5 A |
| 5,083,716 | 1/1992 | Colli et al. | 242/35.5 A |
| 5,273,224 | 12/1993 | Nakagawa et al. | 242/35.5 A |

*Primary Examiner*—Michael R. Mansen

*Attorney, Agent, or Firm*—Armstrong, Westerman, Hattori, McLeland & Naughton

[57] ABSTRACT

A yarn winding tube supplying apparatus for a winder, including: a doffing device which can travel along a winder having a number of winding units disposed thereon, a storage tube box for storing yarn winding tubes used by the doffing device during doffing, the storage tube box being provided on the winding units, a conveyor for supplying the yarn winding tubes to the storage tube box, the conveyor being provided along the winder, and drop-in mechanism for dropping the yarn winding tubes conveyed by the conveyor into the storage tube box as desired. First, the winding tubes are conveyed to the winding unit as desired by the conveyor, the drop-in mechanism is operated by the winding unit as desired, and the winding tubes are dropped into the storage tube box of the desired winding unit.

5 Claims, 6 Drawing Sheets

YARN TAKE-UP TUBE SUPPLYING APPARATUS FOR A WINDER

BACKGROUND OF THE INVENTION

1. Field of the Invention

The present invention relates to a yarn take-up tube such as a paper tube supplying apparatus comprising a doffing device which can travel along a winder having a number of winding units disposed thereon such as an automatic winder, and storage means which store yarn take-up tubes used by the doffing device during doffing, the storage means being provided on the winding units. In particular, the present invention relates to an apparatus in which a supply of paper tubes to the storage means for the winding units can be automatically accomplished.

2. Prior Art

The entire doffing system including a yarn take-up tube supplying apparatus in an automatic winder will be explained with reference to FIG. 6. Reference numeral 1 designates to a frame of an automatic winder; 2 winding units disposed on the frame 1, 3 a box as storage means for each winding unit; 4 a discharge conveyor for package P disposed along the back of the winder; 5 a rail disposed above the winder; and 6 a doffing device capable of travelling along the automatic winder by the rail 5. This doffing device 6 performs a series of operations as described below. When a package P is finished to be wound by a specific winding unit 2, unwinding is interrupted and a lamp 11 is lighted. The doffing device 6 detects the lighting of the lamp 11 and stops before a spindle thereof. The doffing device then picks up a yarn Y. Thereafter, a cutter cuts the yarn Y and holds a lower yarn. After this, a cradle arm 10 is opened to discharge the package P onto the discharge conveyor 4. A paper tube 13 is held and carried from the paper tube box 3 to the cradle arm 10. Next, the yarn Y is put between the paper tube and the cradle arm 10, and the thus put yarn Y is moved to a bunch winding position where the bunch winding takes place. Then, a button 12 is depressed to allow the winding unit 2 start.

Machines and tools provided on the doffing device 6 which carries out a series of doffing operations as mentioned above will be explained with reference to FIG. 7. Reference numeral 15 designates a pick-up for picking up a yarn; 16 a cutter for cutting and holding a yarn; 17 an opener for opening and closing the cradle arm; 18 chucker for holding and carrying a paper tube to the cradle arm; 19 a yarn moving lever for moving a yarn to a predetermined position; 20 a roller for rotating a package or a paper tube during a yarn picking and a bunch winding; and 21 a hooker for vertically moving the cradle arm 10. Although the shown machines and tools are in standby state, when a row of cams 22 is rotated, the machines and tools assume a predetermined position in predetermined order to effect a predetermined operation.

That is, in FIG. 6, the conventional yarn take-up tube supplying apparatus is composed of the box 3 as storage means of each spindle of the winding unit 2, and the doffing device 6. The chucker 18 of the doffing device 6 holds the paper tube 13 of the box 3 and carries it to the cradle arm 10. Alternatively, there exists a paper tube supplying system in which the doffing device 6 has a larger box in place of the box 3 of each spindle of the winding unit 2. This system is based on the assumption that an automatic winder winds a single kind of yarn around a paper tube. However, in some case, all the spindles of the automatic winder are divided into, for example, two groups, and kinds of yarns A and B are wound by the respective groups, in which case, there is provided the box 3 for each spindle in which each spindle can stock a paper tube corresponding to the kind of yarn.

In the above-mentioned conventional yarn take-up tube supplying apparatus, there is a limit in that the number of paper tubes 13 capable of being received by the box 3 of each spindle is about four at the maximum. It is therefore necessary for an operator to always monitor the state of the box 13 and feed paper tubes corresponding to the kinds of yarns, resulting in requiring labor. In view of this, there has been proposed a yarn take-up tube supplying apparatus in which a conveyor for paper tubes is caused to travel on a travel path of a doffing device, two or more holding portions for receiving paper tubes from the conveyor are rotatably provided within a vertical surface on the doffing device, and a chucker for the doffing device can selectively hold the paper tubes from the holding portions. However, this apparatus has a problem in that since two or more holding portions which rotate within the vertical surface are provided, a large-scaled exclusive doffing device need be newly installed.

SUMMARY OF THE INVENTION

The present invention has been accomplished in view of the problem as noted above with respect to prior art. An object of the present invention is to provide a yarn take-up tube supplying apparatus for a winder which suppresses a formation of a doffing device itself into a large scale to enable an automatic feeding of paper tubes.

For achieving the object, there is provided a yarn take-up tube supplying apparatus for a winder, comprising: a doffing device which can travel along a winder having a number of winding units disposed thereon, storage means which store yarn take-up tubes used by the doffing device during doffing, the storage means being provided on each winding unit, conveyor means for supplying the yarn take-up tubes to the storage means, the conveyor means being provided along the winder, and drop-in means for dropping the yarn take-up tubes conveyed by the conveyor means into the storage means as desired. Preferably, the storage means is capable of storing a plurality of yarn winding tubes, and at least an upper portion thereof is opened so that the tubes can be mounted and removed from the exterior. Further, preferably, the drop-in means is provided on the doffing device.

A supply of yarn take-up tubes to the winding units is done first by conveying the tubes to the winding unit as desired by means of the conveyor means, operating the drop-in means at the winding unit as desired, and dropping the yarn take-up tube conveyed by the conveyor means into the storage means for the winding unit as desired. If the storage means is capable of storing a plurality of yarn winding tubes and mounting and removing the yarn take-up tubes from the exterior, it is possible to switch operations between automatic and manual. If the drop-in means is provided on the doffing device, the number thereof can be reduced as compared with the case where it is provided on each winding unit.

DETAILED DESCRIPTION OF PREFERRED EMBODIMENTS

Figure 1:
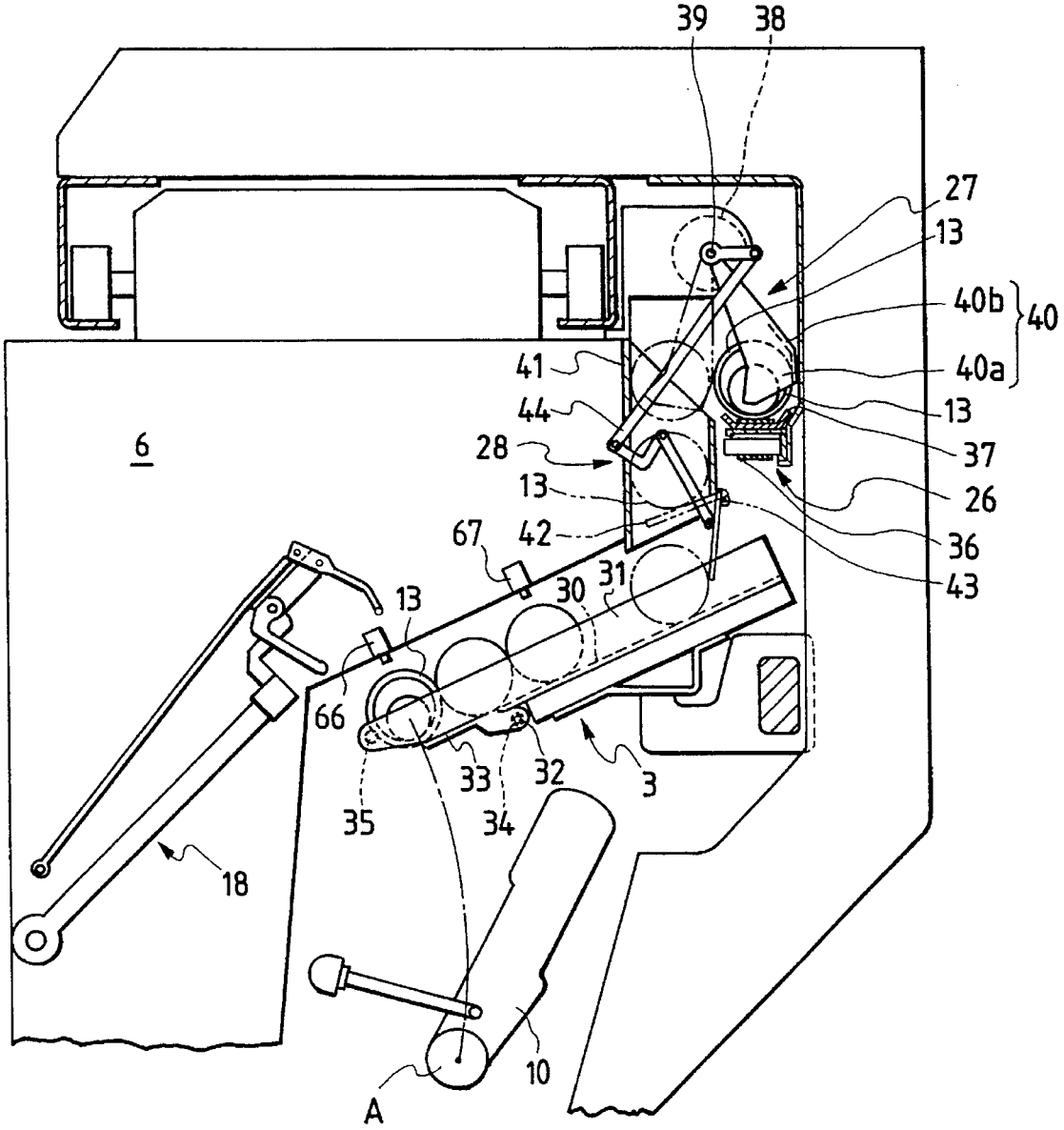
FIG. 1 is a side view showing essential parts of a yarn take-up tube supplying apparatus according to the present invention.
Figure 2:
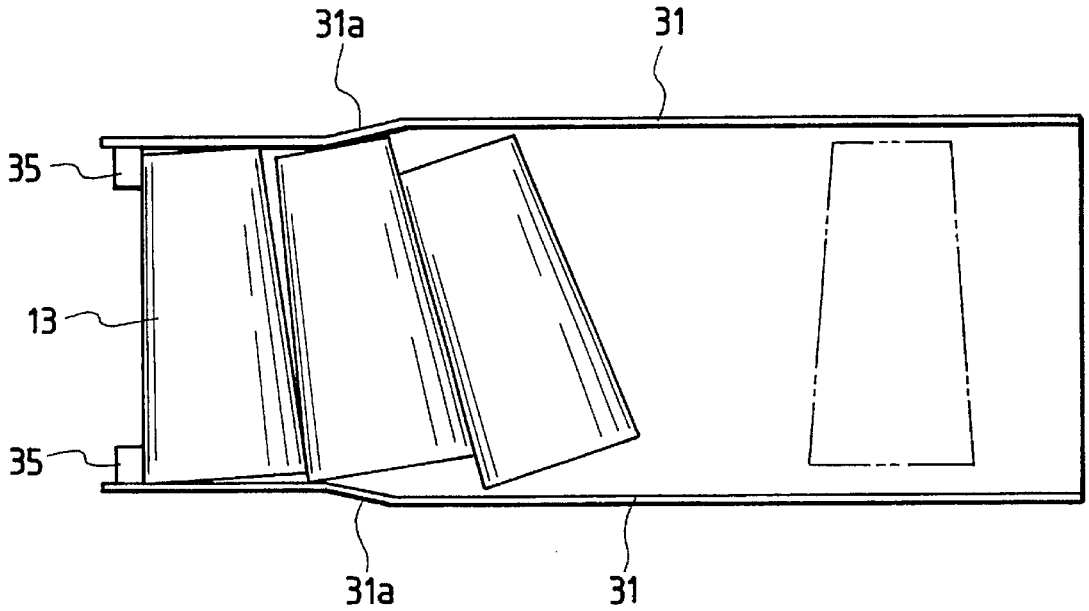
FIG. 2 is a top view of a box.

Hereinafter, embodiments of the present invention will be described by referring to the drawings. FIG. 1 is a side view showing essential parts of a yarn take-up tube supplying apparatus according to the present invention and FIG. 2 shows a top view of a paper tube box (storage box).

Figure 6:
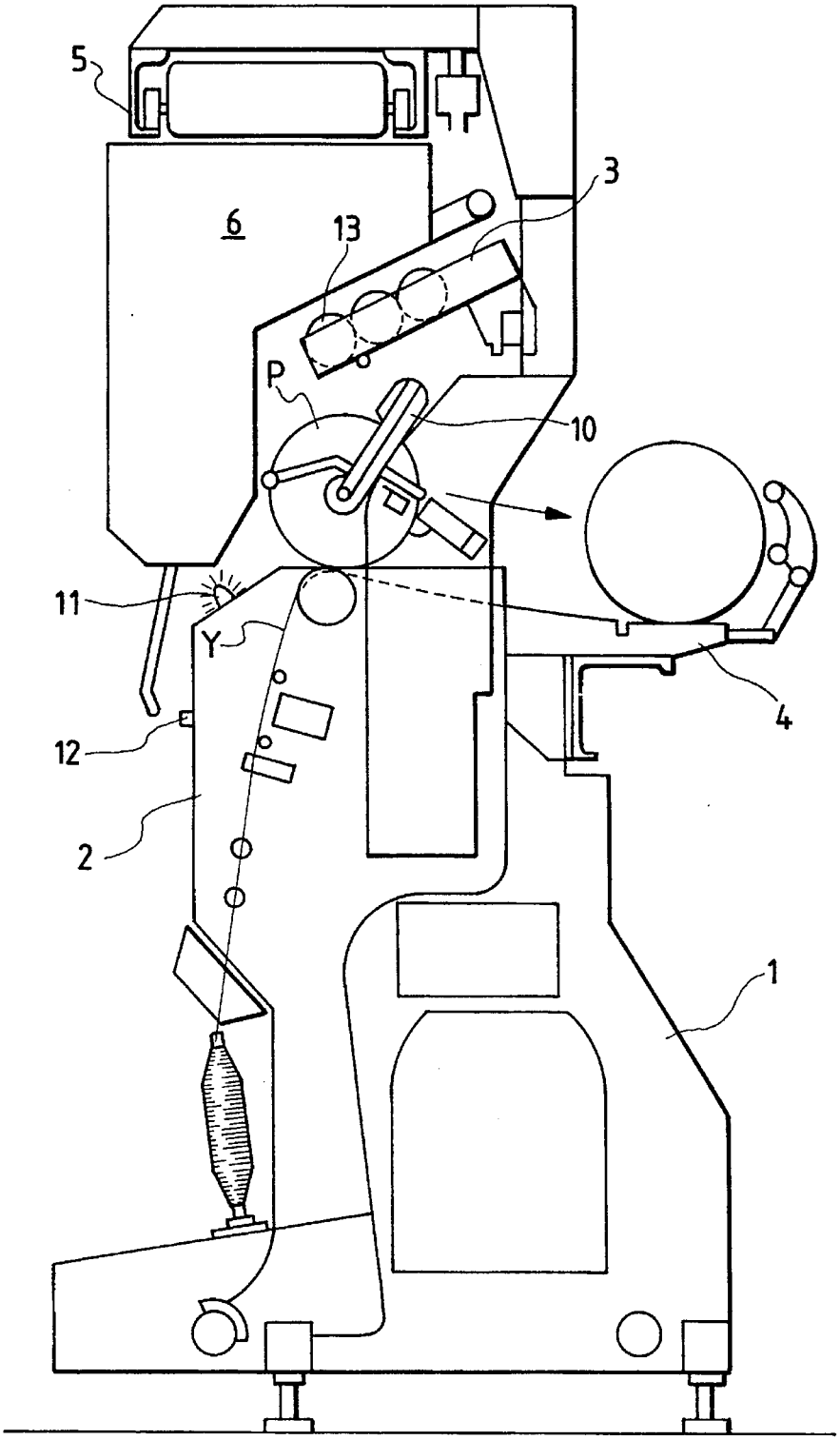
FIG. 6 PRIOR ART
FIG. 6 is a sectional view of a conventional automatic winder.
Figure 7:
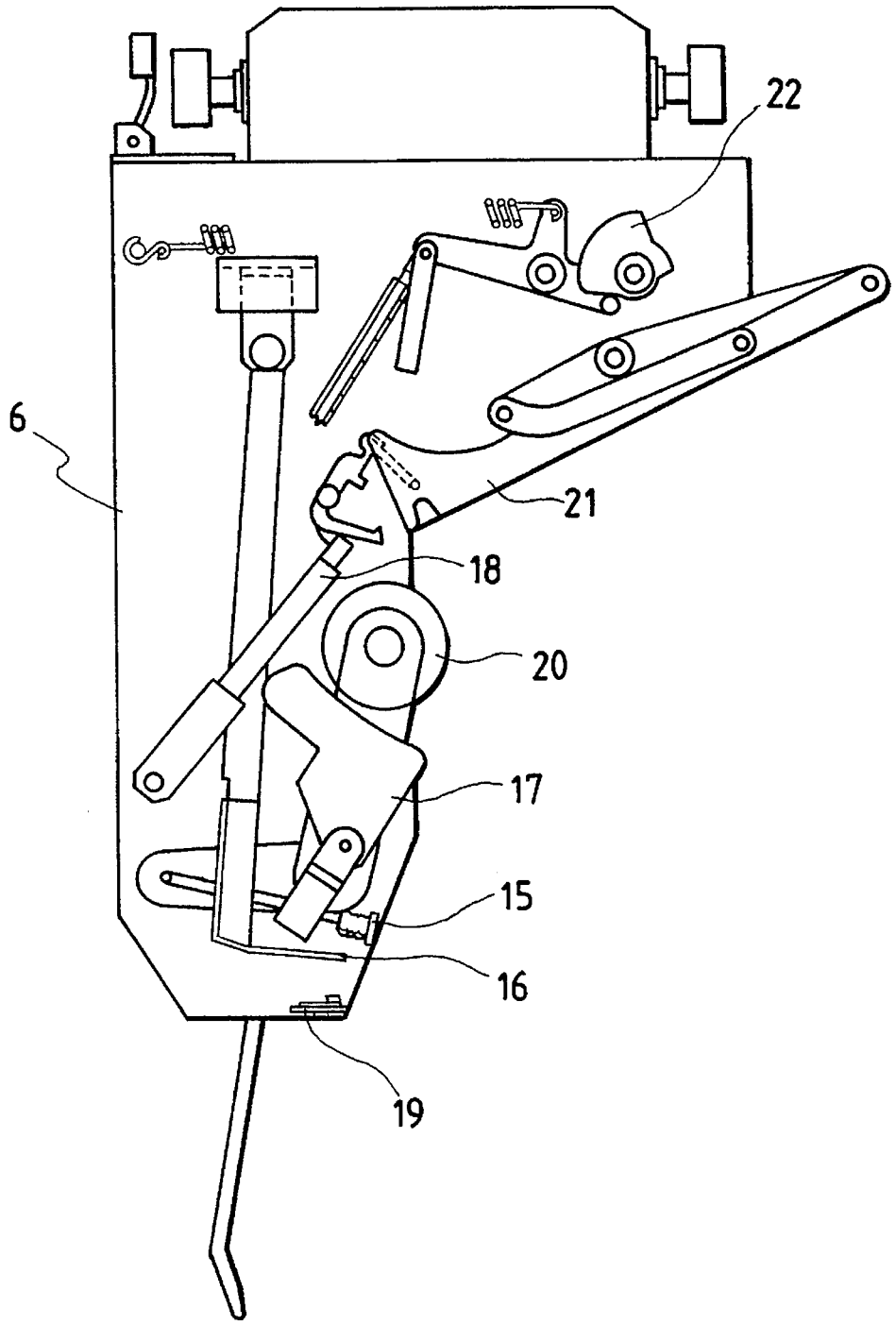
FIG. 7 PRIOR ART
FIG. 7 is a view of arrangement of machines and tools of a conventional doffing device.

In FIG. 1, the configuration different from that as explained in connection with FIGS. 6 and 7 is that a conveyor 26 (conveyor means) is mounted above an inlet side of a paper tube box 3 (storage means) of an automatic winder 1, and a doffing device 6 has a delivery device 27 as drop-in means and a chute 28 with a damper or damper means 42 mounted thereon.

The construction of the box 3 will be explained. Side plates 31 are provided on both left and right sides of an oblique bottom plate 30, and a rocking plate 33 is provided on a shaft 32 at the extreme end of the bottom plate 30, the rocking plate 33 being urged by a spring 34 in a closing direction. When the extreme end of the rocking plate 33 is turned downward about the shaft 32, the bottom of the extreme end of the box 3 is opened, and a paper tube 13 can pass through the opened portion. As shown in FIG. 2, the side plate 31 is narrowed inwardly in the middle portion 31*a* toward the extreme end so that the paper tube 13 can just enter therein. A stopper pawl 35 is projected at the extreme end internally of the side plate 31, and the paper tube 13 at the extreme end assumes a predetermined attitude. The number of the paper tubes 13 stored whose attitude is corrected by the side plate 31 is three (3) at the maximum. As described above, the box 3 has its construction in that at least its upper portion is opened so that the paper tube 13 can be easily mounted and removed from the exterior.

Turning to FIG. 1, the paper tube box 3 is provided above the cradle arm 10 of each winding unit, and a chucker 18 of the doffing device 6 holds the paper tube 13 at the extreme end of the box 3, pushes down the rocking plate 33, and carries the paper tube 13 to the center A of the cradle arm 10.

Figure 3:
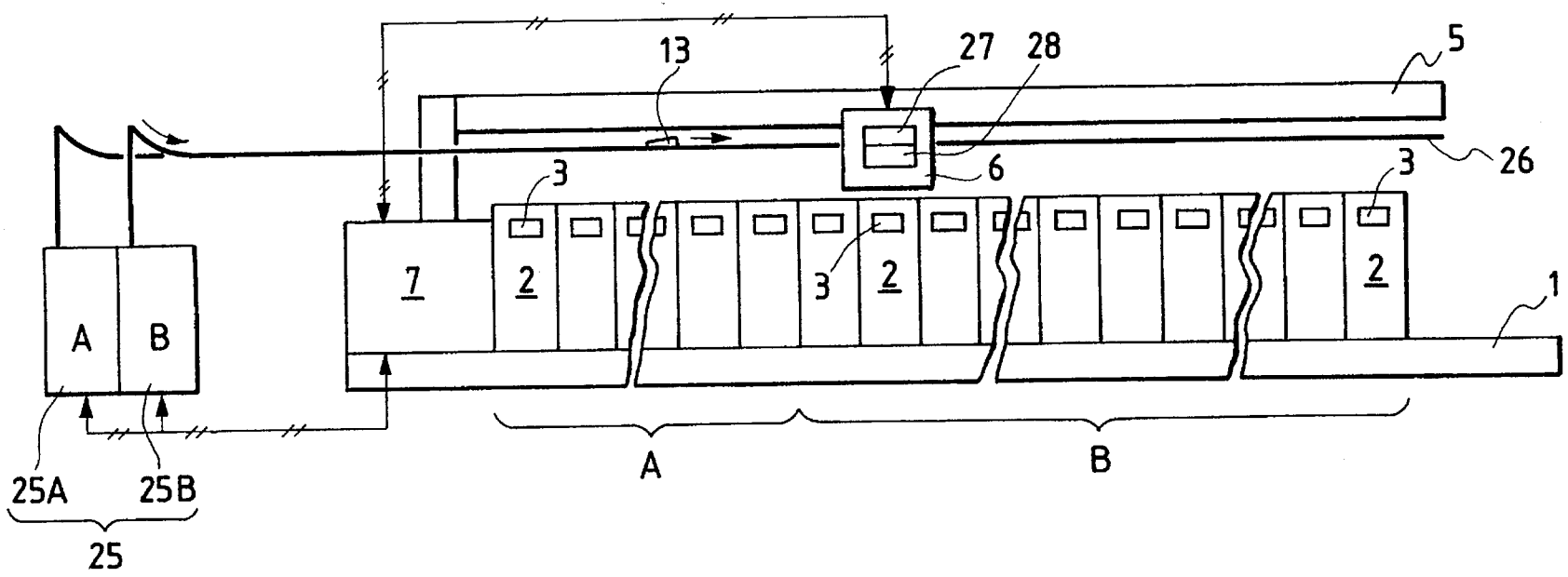
FIG. 3 is a system view for supplying yarn take-up tubes.

On the back of the doffing device 6, which forms a space above an inlet of the box 3, are mounted a delivery device (drop-in means) 27 and a chute with a damper (damper means) 42. A conveyor 26 extending thickness-wise of a paper surface is provided at a position in which the delivery device 27 can be operated. As shown in FIG. 3, the conveyor 26 is provided along the winding unit 2 of the winder, the delivery device (drop-in means) 27 and the chute with a damper (damper means) 42 are provided on the doffing device 6, and the box 3 is provided on each winding unit 2.

The conveyor 26 shown in FIG. 1 is designed so that an endless belt 36 is disposed to be travelled along a guide 37, and a paper tube 13 placed laterally is conveyed on the upper endless belt 36. The delivery device (drop-in means) 27 is designed so that a rocking arm 40 is mounted on a shaft 39 of a rotary solenoid 38. The rocking arm 40 has an L shape in section having a contact plate 40*a* and a delivery plate 40*b*. The paper tube 13 conveyed by the conveyor 26 abuts the contact plate 40*a* of the rocking arm 40 at the solid line moved onto the conveyor 26 and stops. When the rocking arm 40 rocks to a position indicated by a two-dot chain line retracted from the conveyor, the delivery plate 40*b* delivers the paper tube 13 from the conveyor 26, and the paper tube 13 is dropped into the chute 28 with a damper.

The chute 28 with a damper 42 serves as guide means which receives the paper tube 13 delivered from the conveyor 26 to guide it to the inlet of the box 3 and constitutes a cylindrical body 41 having a square in section. Damper 42 is provided at a lower outlet of the cylindrical body 41 so that the former can rock with respect to a shaft 43. The damper 42 is connected to a shaft 39 of the rotary solenoid 38 through a link mechanism 44, and operatively connected to the rocking arm 40. More specifically, when the rocking arm 40 is at an operating position indicated by the solid line, the damper 42 is opened, whereas when the rocking arm 40 assumes a standby position as indicated by a two-dot chain line, the damper 42 is closed. When the rocking arm 40 rocks from the solid line to the two-dot chain line, the paper tube 13 is dropped onto the closed damper 42. When the rocking arm 40 oscillates from the two-dot chain line to the solid line, the paper tube 13 is dropped from the damper 42 into the box 3. In this way, when the paper tube 13 is dropped-in in two stages so as to divide a level in height into two parts, the shock occurring during the dropping-in is so small that a damping action is exerted. As a result, it is possible to prevent the attitude of the paper tube 13 dropped into the position indicated by the two-dot chain line shown in FIG. 2 from being unstable, and the paper tube 13 from jumping out of the box 3.

An example of a system of a supply of yarn winding tubes provided with the above-mentioned yarn take-up tube supplying apparatus will be described with reference to FIG. 3. In FIG. 3, reference numeral 1 designates to a frame; 2 a winding unit; 5 a rail for allowing a doffing device 6 to a travel along a plurality of winding units 2; 6 a doffing device; and 7 a controller for a winder. This controller 7 is capable of being communicated with a control box, not shown, of the winding unit 2, and grasps which spindle is full and stops. These structures are similar to those of prior art, but in particular, a replenishing device 25 having two feed-out portions 25A and 25B is mounted at one end (at left end in FIG. 3) of the winder. The conveyor 26, extending from the replenishing device 25, is provided along the travel path of the doffing device 6. Further, the doffing device 6 is provided with the delivery device 27 and the chute 28 with a damper as described above. Furthermore, the winding units 2 are divided into an A-kind group and a B-kind group as shown, and the box 3 is provided on each winding unit 2.

The operation of the above-mentioned yarn take-up tube supplying system will be described hereinbelow. It is assumed that the winding unit 2 of the B-kind is full and stops. The doffing device 6 travels to a position before the spindle (the illustrated position). After this, the paper tube 13 of the B-kind is delivered from the replenishing device 25 to the conveyor 26. The doffing device 6, at the shown position, discharges the full package, and after this, the paper tube of the B-kind, stored, in the box, is held by the chucker and set to-the cradle arm. The paper tube 13 of the B-kind, conveyed on the conveyor 26, is dropped in the chute 28 with a damper by the delivery device 27 of the doffing device 6 and guided by the chute 28 with a damper. The falling energy is damped thereby to replenish paper tubes in the box 3. The doffing device 6 travels to a spindle which requires doffing. The same operation is repeated. The yarn take-up tube supplying apparatus according to the present invention is not limited to use for multi-kind but can be also applied to the case of a single kind. In this case, paper tubes delivered out of the replenishing device are a single kind.

A plurality (three in the illustration) of paper tubes 13 are stored in the box 3, and even if an abnormality occurs in the yarn take-up tube supplying system to stop a supply, there is time to spare till paper tubes run out in each winding unit. Accordingly, it is not necessary to immediately stop the entire winder due to the abnormality of the yarn take-up tube supplying system, and there is time to spare for inspection. Further, it is possible to simply switch the system to a manual supplying system for manually supplying necessary paper tubes to the box without relying on the yarn winding tube supplying system.

Furthermore, since the store means 3 is provided in each winding unit, the doffing operation may start immediately without waiting the delivery of a paper tube to the subjective winding unit when the doffing device 6 arrives at the unit where the doffing operation is requested. The delivery of a paper tube to the unit which requests the doffing operation may be done during the doffing operation. So, the doffing time per one unit can be shortened.

In this yarn take-up tube supplying system, the doffing device 6 is provided with optical sensors 66, 67, and the optical sensors 66, 67 are electrically connected to the control device 7. The optical sensor 66 detects the presence or absence of a first paper tube 13 in the box 3, that is, the presence or absence of the paper tube 13 in the winding unit 2. If the sensor 66 detects absence of a paper tube 13 within the box 3 of the winding unit 2 which requests the doffing operation, the control device 7 outputs a command of stop of the doffing operation to the doffing device 6. According to the command, the doffing device 6 does not process the doffing operation at this winding unit 2 and travels to the another winding unit 2 which requests the doffing operation. A miss in the doffing operation can be prevented because the doffing operation is not processed when there is not a paper tube 13 in the box 3 of the winding unit 2 which requests the doffing operation.

The optical sensor 67 detects the presence or absence of the third paper tube 13 in the box 3, that is, whether the number of the paper tubes 13 stored in the box 3 is decreased from the predetermined number and is used in the following case. In this yarn take-up tube supplying system, it is so designed as a winding mode is automatically switched to a paper tube supplying mode if none of the winding units 2 requests the doffing operation. When the paper tube supplying mode is selected and the mode is changed thereto, the control device 7 outputs a command to the doffing device 6. According to the command, the doffing device 6 finds out by means of the optical sensor 67 the winding unit 2 in which the paper tubes 13 are decreased. When the doffing device 6 finds out the subjective winding unit 2, it stops at the winding unit 2 and processes the paper tube supplying operation till the optical sensor 67 detects the presence of the third paper tube 13. Accordingly, the number of the paper tubes 13 in the box 3 may be automatically repaired to the predetermined number if the paper tubes 13 in the box 3 are used in accordance with the operation regulated in a manual.

Figure 4:
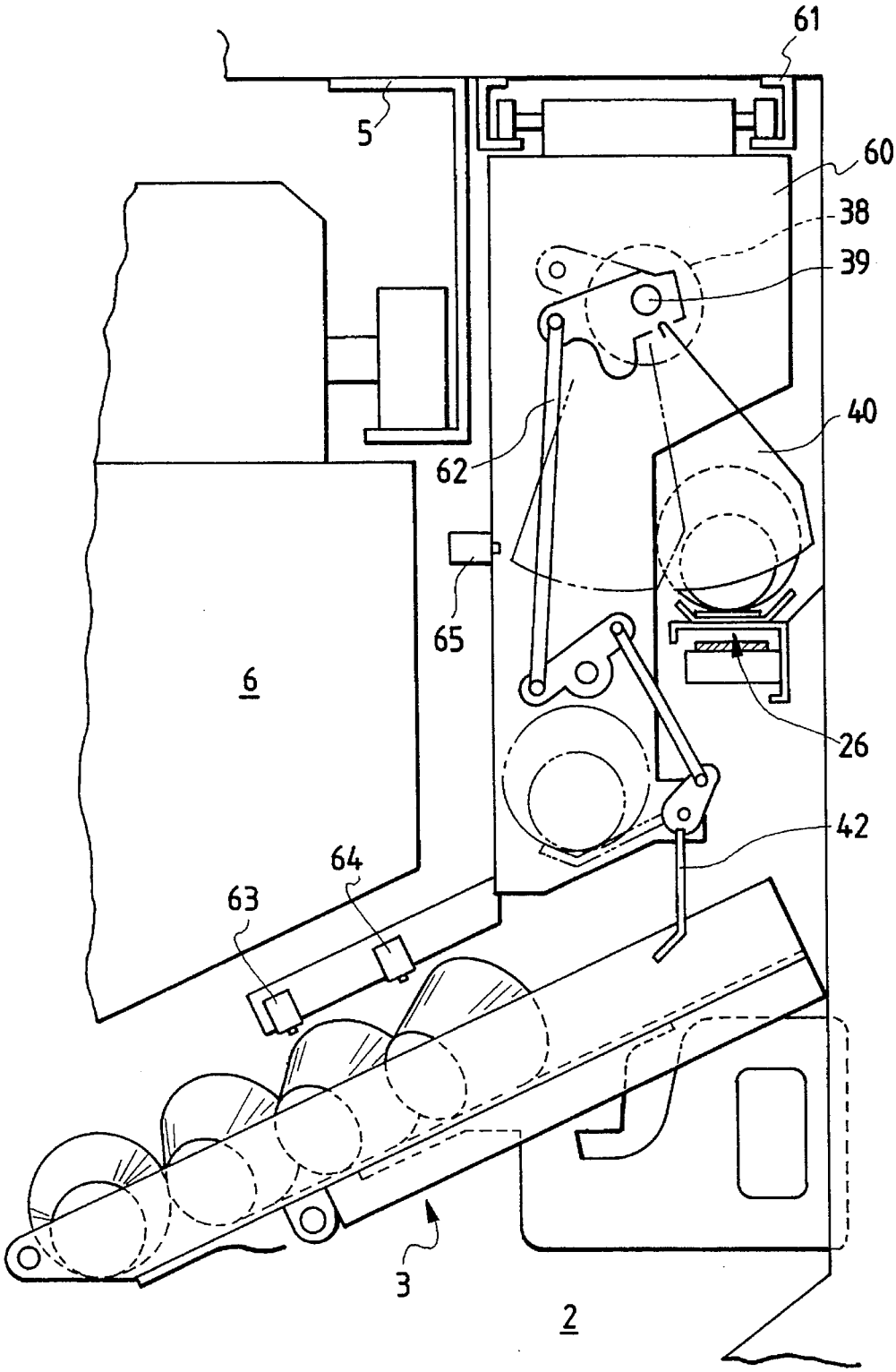
FIG. 4 is a side view showing essential parts of another embodiment of a yarn take-up tube supplying apparatus according to the present invention.

FIG. 4 is a side view showing another embodiment of a yarn take-up tube supplying apparatus according to the present invention. The drop-in means is separated from the doffing device 6 for the separate travel with the doffing device 6. An angle rail 61 for a travel bogie 60 is provided along a rail angle 5 for the doffing device 6 so that the travel bogie 60 travels on the conveyor 26 and travels across the box 3. The travel bogie 60 is provided with a rocking arm 40 connected to a shaft 39 of a rotary solenoid 38 and a damper 42 operatively connected through a link mechanism 62, similar to FIG. 1. The operation of the rocking arm 40 and the damper 42 is the same as described in FIG. 1. The travel bogie 60 is provided with a first optical sensor (for the third paper tube) 63 and a second optical sensor (for the fourth paper tube) 64 for detecting the presence or absence of a paper tube on the box 3, and a third optical sensor 65 for detecting a clogging of paper tubes discharged from the conveyor 26. When a box from which paper tubes run out is detected by the first and second optical sensors 63 and 64, the travel bogie 60 stops. The paper tubes fed from the conveyor 26 are then-discharged by the rocking arm 40 and placed on the damper 42. At this time, when the clogging within the chute is detected by the third optical sensor 65 and the clogging occurs, an alarm is generated to call an operator. When the rocking arm 40 rocks from the two-dot chain line to the solid line, the paper tube on the damper 42 is discharged onto the box 3. The above operation is repeated to automatically supply paper tubes to the box 3.

Figure 5:
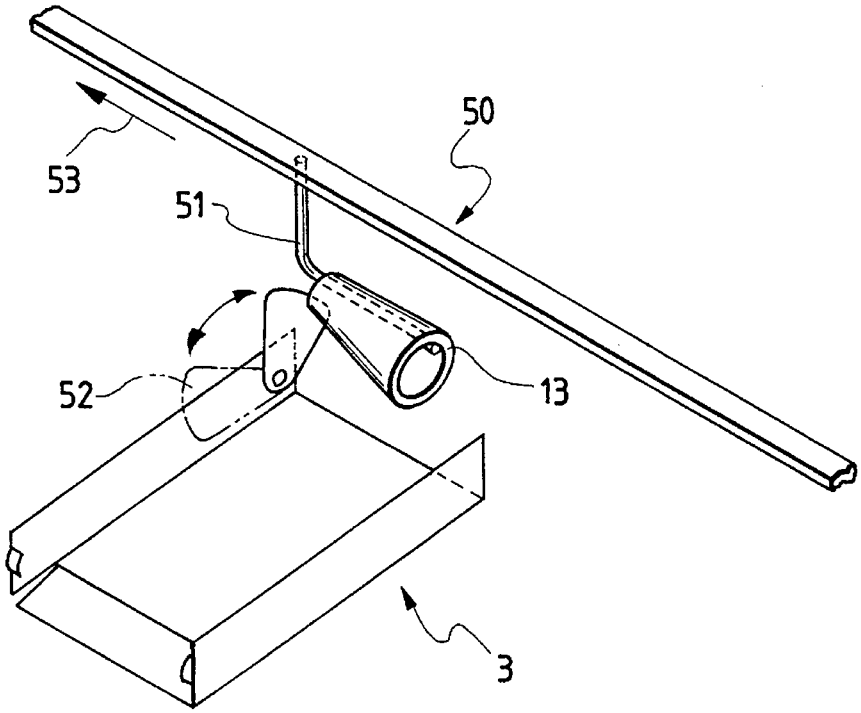
FIG. 5 is a perspective view showing essential parts of still another embodiment of a yarn take-up tube supplying apparatus according to the present invention.

FIG. 5 is a perspective view showing a further embodiment of a yarn take-up tube supplying apparatus. As the conveyor means, an overhead conveyor 50 having hangers 51 mounted at predetermined intervals thereon is used in place of the conveyor using a belt. As the drop-in means, a rocking stopper member 52 mounted on the box 3 is used in place of the delivery device mounted on the doffing device. The paper tube 13 put into the hanger 51 is conveyed in a direction as indicated by an arrow 53. When a stopper member 52 of the box 3 corresponding to the winding unit which requires a replenishment of paper tubes rocks from a retracted position indicated by the two-dot chain line to an operating position indicated by the solid line, the stopper member 52 abuts the end of the paper tube 13 so that the paper tube 13 is pulled out of the hanger 51 and dropped into the box 3. In the case where a difference in level between the hanger 51 and the box 3 is small, a chute with a gate as the damper means is not required.

The apparatus provided with a winder having a number of winding units disposed is not only applied to an automatic winder but also can be also applied to various textile machinery including a winder having a number of winding units disposed thereon such as a two-for-one twister, a spinning frame, a doubler, and so on. Further, a winding tube is not limited to a paper tube but can be a resin tube.

According to the yarn take-up tube supplying apparatus for a winder in the present invention, the yarn winding tube is conveyed to a winding unit as desired by the conveyor means, and the drop-in means is operated by the winding unit as desired to drop the yarn winding tube into the storage means of each winding unit. Therefore, a supply of yarn take-up tubes for a winder in which each winding unit has storage means can be automated merely by adding the storage means and the drop-in means. If each winding unit has storage means for storing a plurality of yarn take-up tubes, switching can be made between an automatic yarn take-up tube supply.and a manual yarn take-up tube supply. Further, since the doffing device need not to hold a yarn take-up tube, it is not necessary to be large-scaled, but a vacant space of a conventional manual machine can be utilized to provide conveyor means and drop-in means. The manual machine can be remodeled.

What is claimed is:

1. A yarn take-up tube supplying apparatus for a winder, comprising:

a winder having a number of winding units in a row;

a doffing device movably positioned at the side of said winder for transferring yarn take-up tubes;

a storage means for storing take-up tubes, said storage means being provided on each of said winding units;

conveyor means provided along said winder and above said storage means for supplying said yarn take-up tubes to said storage means; and drop-in means for dropping the yarn take-up tubes conveyed by said conveyor means into said storage means, said drop-in means including dampening means for engaging and releasing each of said tubes as said tubes are dropped in said drop-in means from said conveyor into said storage means.

2. A yarn take-up tube supplying apparatus for a winder as recited in claim 1, wherein said drop-in means is provided on said doffing device.

3. A yarn take-up tube supplying apparatus for a winder as recited in claim 1, wherein said drop-in means is operable independently from said doffing device.

4. A yarn take-up tube supplying apparatus for a winder comprising:

a winder having a number of winding units in a row;

a doting device movably positioned at the side of said winder for transferring yarn take-up tubes;

a storage means for storing yarn take-up tubes, said storage means being provided on each of said winding units;

conveyor means provided along said winder for supplying said yarn take-up tubes to said storage means; and drop in means provided on said doting device for dropping the yarn take-up tubes conveyed by said conveyor means into said storage means, said drop-in means further comprises:

a rotary solenoid having a shaft;

a rocking arm pivotally mounted on said shaft of said rotary solenoid; and a chute with a damper for guiding the take-up tubes supplied by said rocking arm and dropping said tubes into said storage means, wherein said rocking arm is swingable between said conveyor means and said chute.

5. A yarn take-up tube supplying apparatus for a winder as recited in claim 4, wherein said damper provided at a lower outlet of said chute is pivotally connected to said shaft of said rotary solenoid through a link mechanism so that the take-up tube is dropped from said damper when said rocking arm swings.

* * * * *